United States Patent [19]

Meshri

[11] 4,295,365

[45] Oct. 20, 1981

[54] NMR ANALYSIS OF SUBTERRANEAN RESERVOIR SAMPLES IMMERSED IN LIQUID HALOCARBONS

[75] Inventor: Indurani D. Meshri, Tulsa, Okla.

[73] Assignee: Standard Oil Company (Indiana), Chicago, Ill.

[21] Appl. No.: 15,267

[22] Filed: Feb. 26, 1979

[51] Int. Cl.[3] ..... E21B 49/02

[52] U.S. Cl. ..... 73/153; 324/307

[58] Field of Search ..... 324/300, 303, 313, 316, 324/307, 308, 309; 73/153; 422/50, 98

[56] References Cited

U.S. PATENT DOCUMENTS 2,662,401 12/1953 Bailly ..... 73/153

2,973,471 2/1961 Armistead et al. ..... 73/153 X

OTHER PUBLICATIONS

Timur, A., Pulsed Nuclear . . . Sandstones, Jun. '69, pp. 775–786, from Journal of Petroleum Technology.

*Primary Examiner*—Jerry W. Myracle

*Attorney, Agent, or Firm*—Fred E. Hook; William E. Murray

[57] ABSTRACT

A sample of a subterranean formation is prepared for NMR analysis by saturating the sample with an aqueous liquid and then immediately immersing it in a liquid halocarbon. An NMR analysis is conducted on the immersed sample. The liquid halocarbon does not have hydrogen atoms bound thereto which would interfere with the NMR analysis and preferably has a sufficient viscosity to substantially eliminate the displacement of aqueous liquid from the sample. The sample can be stored in the liquid halocarbon for maintaining aqueous liquid within the sample.

5 Claims, No Drawings

NMR ANALYSIS OF SUBTERRANEAN RESERVOIR SAMPLES IMMERSED IN LIQUID HALOCARBONS

SUMMARY OF THE INVENTION

In the nuclear magnetic resonance determination of porosity and bound water of a sample from a subterranean reservoir, the sample is saturated with brine and the saturated sample is analyzed. The sample is first treated to remove all of the fluid from the sample, then it is saturated with an aqueous fluid having a sufficient salinity to prevent clays from swelling and fine grained mineral from dispersing. In the improvement of this invention, the sample is placed in a liquid halocarbon immediately after it is saturated. Thereafter, the sample immersed in the halocarbon is subjected to the analysis. The halocarbon has no hydrogen bound thereto and preferably has sufficient viscosity to substantially eliminate the displacement of the aqueous liquid from the sample. A suitable liquid halocarbon is a liquidd polychlorotrifloroethylene having a viscosity of greater than about 5 centipoise. Additionally, samples of a subterranean formation can be stored in the liquid halocarbon for maintaining aqueous liquid within the samples.

DETAILED DESCRIPTION

Samples of a subterranean reservoir can be analyzed for determining the porosity of the reservoir, i.e., the volume of the reservoir which can be occupied by fluids such as natural gas, crude oil, and water. In one method of determining the porosity of a reservoir, samples of the reservoir such as a core cut from the reservoir or cuttings from a drill hole penetrating the reservoir are evacuated and then saturated with an aqueous liquid such as a brine having sufficient salinity to prevent clays within the sample from hydrating or swelling or the fine grained minerals from being dispersed. The saturated sample is then analyzed by a nuclear magnetic resonance means (NMR) for measuring excitation of hydrogen nucleii in the aqueous liquid and the rate of spin-lattice decay or relaxation.

The excitation of the sample is effected by placing the sample in the NMR's permanent magnetic field for aligning the hydrogen nucleii or proton dipoles in the sample with the permanent magnetic field and supplying to the sample, through a coil surrounding the sample and aligned at right angles to the permanent magnetic field, a radio frequency pulse of a proper amplitude, frequency, and duration for causing the proton dipoles to rotate about 90° into alignment with the coil. The radio frequency pulse is then terminated and the permanent magnetic field causes rotation of the proton dipoles into realignment with the permanent magnetic field. This realignment with the permanent magnetic field is referred to herein as the decay of proton excitation and as spin-lattice relaxation.

The rate of return of the proton dipoles into realignment with the permanent magnetic field or spin-lattice relaxation is affected by such elements in the environment of the proton as the magnetic coupling between the hydrogen nucleii and certain components of the minerals at the water-sample interface.

The measurement of spin-lattice relaxation is effected by the generation of a radio frequency signal in the coil of the NMR as the proton dipoles rotate into realignment with the permanent magnetic field. The amplitude of this radio frequency signal is proportional to the quantity of hydrogen nucleii within the sample and spinlattic relaxation time is proportional to the pore size distribution of the sample.

It has now been found that the reproducibility of NMR analyses of samples of subterranean reservoirs can be increased by immersing the samples in a liquid halocarbon immediately after saturating the samples with the aqueous liquid and then conducting an NMR analysis on the immersed samples. The liquid halocarbon has no hydrogen atoms bound thereto which would be subject to the NMR's magnetic field and preferably has a viscosity of greater than about 5 centipoise, which is generally a sufficient viscosity to prevent displacement of aqueous liquid from the samples. The most preferred liquid halocarbons have viscosities of about 5 to about 15 centipoise.

Suitable halocarbons for use in this invention include but are not limited to polychlorotrifloroethylenes. These halocarbons are chemically inert and do not contain hydrogen that would be activated in the NMR's magnetic field. Additionally, these polychlorotrifloroethylenes can be selected which have viscosities of about 5 to about 15 centipoise.

In the preparation of samples for NMR analyses, the samples such as cores or drill cuttings are first treated by suitable means such as heat, vacuum, and/or fluid flushes for removing substantially all of the fluid from the pore spaces of the samples. This is necessary when the samples contain fluids other than aqueous fluids. The samples are then saturated with an aqueous liquid such as a brine having sufficient salinity for preventing clays within the samples from swelling and to prevent dispersion of fine grained minerals. Samples can be placed in the aqueous liquid under reduced pressure to assure complete saturation thereof. Immediately after saturating the samples, they are immersed in the liquid halocarbon and the immersed samples are subjected to the NMR analyses. Excess water should be removed from the surface of the samples prior to immersing them in the halocarbon. The samples can be removed from the aqueous liquid and blotted with an absorbent material such as a tissue paper to remove the excess water from their surface.

The use of liquid halocarbons in NMR analyses is illustrated by comparative NMR analyses of a formation sample immersed in liquid halocarbon and wrapped in Saran brand plastic wrap marketed by the Dow Chemical Company. The tests were conducted in a pulsed NMR analyzer with a 25 mm probe, Model No. PR-103, manufactured by the Praxis Corporation. This NMR analyzer has a permanent magnet and a coil to which a radio frequency pulse can be applied and from which an induced radio frequency signal can be amplified. The axis of the coil is at right angles to the permanent magnetic field direction. This NMR analyzer is designed to measure the magnetic behavior of hydrogen nucleii.

When a sample containing hydrogen is placed in the probe, all of the proton dipoles become aligned with a permanent magnetic field of about 2.51 kilogauss. A radio frequency pulse of about 10.72 megahertz for about 12 microseconds is then applied to the coil for generating a magnetic field at right angles to the permanent magnetic field. This radio frequency pulse causes a 90° rotation of the hydrogen nucleii into alignment with the magnetic field created by the pulse. At the termination of the pulse, the nucleii or proton dipoles lose their energy to the environment and rotate back into alignment with the permanent magnetic field. The 90° rotation of the protons back into alignment with the permanent magnetic field induces a radio frequency current in the coil of the PR-103 analyzer which is displayed in terms of amplitude.

The sample for this comparative analysis was a core from a subterranean formation having a length of about 2.54 centimeters, a diameter of about 1.91 centimeters, and a volume of about 4.85 cubic centimeters. The core was first flushed with toluene and then dried at about 100° C. under vacuum. The core was then saturated with aqueous liquid by immersing it in 75,000 parts per million NaCl brine under vacuum until gas was no longer being displaced therefrom. This required about 4 hours. The core was then removed from the brine and immediately wrapped in the plastic wrap to prevent additional water loss. The water on the exterior surface of the core was removed prior to wrapping it. The core was then analyzed in the PR-103 NMR analyzer at about 32° C. for amplitude and spin-lattice relaxation time. The core was then resaturated by the above described procedure, removed from the brine and immersed in a polychlorotrifloroethylene having a specific gravity of about 1.86 and a viscosity of about 11 centipoise at 32° C. The water on the exterior surface of the core was removed prior to immersing it in the liquid halocarbon. The immersed core was then analyzed in the PR-103 analyzer at 32° C. for amplitude and spin-lattice relaxation time. The immersed core was maintained at about 32° F. for about one week, analyzed for a second time immersed in the halocarbon, thereafter maintained at about 32° F. for about one month and then analyzed for a third time immersed in the halocarbon.

The analysis of the wrapped core and each of the three times while the core was immersed in the halocarbon gave about the same results. In each analysis, the core had about the same maximum amplitude and a spin-lattice relaxation time of about 50 milliseconds after about 80% of the amplitude had been generated in the coil. Cores stored in the plastic wrap will lose water due to evaporation and will not give an NMR analysis after storage which is about the same as an NMR analysis immediately after wrapping the cores in the plastic wrap.

While certain embodiments of the invention have been described for illustrative purposes, the invention is not limited thereto and various other modifications or embodiments of the invention will be apparent to those skilled in the art in view of this disclosure since modifications or embodiments are within the spirit and scope of the disclosure.

What is claimed is:

1. In a method of analyzing a sample of a subterranean reservoir with a nuclear magnetic resonance means, wherein said sample is saturated with an aqueous liquid and thereafter analyzed with said nuclear magnetic resonance means, wherein the improvement comprises:

immediately after saturating said sample, immersing it in a liquid halocarbon having no hydrogen atoms bound thereto and analyzing said sample immersed in said liquid halocarbon.

2. In a method of analyzing a sample of a subterranean reservoir with a nuclear magnetic resonance means, wherein said sample is saturated with an aqueous liquid and thereafte analyzed with said nuclear magnetic resonance means, wherein the improvement comprises:

immediately after saturating said sample, immersing it in liquid polychlorotrifloroethylene and analyzing said samle immersed in said polychlorotrifloroethylene.

3. In a method of storing a sample of a subterranean formation for later analysis, wherein precautions are taken to maintain aqueous liquid within the samle, wherein the improvement comprises: immersing the sample in liquid halocarbon, said halocarbon containing no hydrogen atoms, and storing the sample immersed in said liquid halocarbon.

4. The method of claims 1, 2 or 3 wherein said halocarbon has a viscosity of at least about 5 centipoise at the temperature at which said sample will be subjected to during said later analysis.

5. The method of claims 1, 2 or 3 wherein said halocarbon has a viscosity of about 5 to about 15 centipoise at the temperature at which said sample will be subjected to during said later analysis.

* * * * *